US008308102B2

(12) United States Patent
Lin

(10) Patent No.: US 8,308,102 B2
(45) Date of Patent: Nov. 13, 2012

(54) ROLL SHAFT STRUCTURE

(75) Inventor: Li Lin, Taipei (TW)

(73) Assignee: Primax Electronics Ltd., Taipei (TW)

( * ) Notice: Subject to any disclaimer, the term of this patent is extended or adjusted under 35 U.S.C. 154(b) by 372 days.

(21) Appl. No.: 12/836,841

(22) Filed: Jul. 15, 2010

(65) Prior Publication Data

US 2011/0284680 A1 Nov. 24, 2011

(30) Foreign Application Priority Data

May 21, 2010 (TW) ..... 99116250 A

(51) Int. Cl.
*B65H 16/04* (2006.01)
*B65H 18/04* (2006.01)
*B65H 75/18* (2006.01)

(52) U.S. Cl. ..... 242/597.6; 400/613

(58) Field of Classification Search ..... 242/571, 242/572, 577, 577.2, 577.4, 596.7, 597, 597.1, 242/597.4, 597.5, 597.6, 599, 599.2, 599.4, 242/606, 612, 613, 129.7, 129.71; 400/613
See application file for complete search history.

(56) References Cited

U.S. PATENT DOCUMENTS 6,095,704 A * 8/2000 Jaeger et al. ..... 400/613
6,609,677 B2 * 8/2003 Seybold et al. ..... 242/611.2
6,609,678 B2 * 8/2003 Seybold et al. ..... 242/611.2
6,824,091 B2 * 11/2004 Inana ..... 242/578.2
6,923,397 B2 * 8/2005 Inana et al. ..... 242/348
6,923,582 B2 * 8/2005 Pomfret ..... 400/242
6,997,629 B2 * 2/2006 Bungert et al. ..... 400/613
7,011,464 B2 * 3/2006 Sekino ..... 400/613
7,284,725 B2 * 10/2007 Inana ..... 242/578.2
7,300,220 B1 * 11/2007 Bakker ..... 400/236
7,350,463 B2 * 4/2008 Blanchard et al. ..... 101/407.1
7,350,992 B2 * 4/2008 Ward ..... 400/196
7,441,971 B2 * 10/2008 Pomfret ..... 400/242
7,506,834 B2 * 3/2009 Lenkl ..... 242/573.7
7,937,915 B2 * 5/2011 Kohn et al. ..... 53/556
2001/0006202 A1 * 7/2001 Inana et al. ..... 242/348
2001/0042810 A1 * 11/2001 Christensen et al. ..... 242/597.2
2003/0173451 A1 * 9/2003 Inana ..... 242/578.2
2005/0249537 A1 * 11/2005 Pomfret ..... 400/242

* cited by examiner

*Primary Examiner* — William E Dondero
(74) *Attorney, Agent, or Firm* — Kirton McConkie; Evan R. Witt

(57) ABSTRACT

A roll shaft structure is provided for fixing a first roll or a second roll. The roll shaft structure includes a shaft body, a first ring and a second ring. The diameter of the shaft body is equal to the inner diameter of the first roll. The diameter of each of the first ring and the second ring is equal to the inner diameter of the second roll. When the shaft body penetrates through the first roll, the shaft body is contacted with the inner wall of the first roll, so that the first roll is fixed on the roll shaft structure. Whereas, when the shaft body penetrates through the second roll, the first ring and the second ring that are fixed on the shaft body are contacted with the inner wall of the second roll, so that the second roll is fixed on the roll shaft structure.

10 Claims, 7 Drawing Sheets

ROLL SHAFT STRUCTURE

FIELD OF THE INVENTION

The present invention relates to a roll shaft structure, and more particularly to a roll shaft structure for use in a thermal transfer printer.

BACKGROUND OF THE INVENTION

Thermal transfer printers have been widely used in modern lives. The common thermal transfer printers include for example faxing machines or the POS (Point of Sale) printers at supermarkets or shops. The configurations of the thermal transfer printers are substantially identical to those of the ordinary printers except for the printing medium and the printing carriers. For example, the ordinary printers supply ink or toner onto papers. Whereas, a thermal transfer printer prints a thermal paper by melting a coating of a ribbon. Generally, for a thermal transfer printer, the ribbon is wound around a ribbon roll, and the thermal paper is wound around a thermal paper roll.

FIG. 1 is a schematic exploded view illustrating a paper supply mechanism of a conventional thermal transfer printer. As shown in FIG. 1, the paper supply mechanism 1 of the conventional thermal transfer printer comprises a first supporting element 11, a second supporting element 12, a first fixing frame 13, a second fixing frame 14 and a first thermal paper roll 15. The first supporting element 11 has a first seam 111. The second supporting element 12 has a second seam 121. The first fixing frame 13 has a first embedding part 131 and a first fixing shaft 132. The second fixing frame 14 has a second embedding part 141 and a second fixing shaft 142. In addition, the first thermal paper roll 15 has a first width W1. A first thermal paper 16 is wound around the first thermal paper roll 15.

A process of installing the first thermal paper roll 15 in the paper supply mechanism 1 will be illustrated as follows. First of all, the first embedding part 131 of the first fixing frame 13 is inserted into a first side of the first thermal paper roll 15, and the second embedding part 141 of the second fixing frame 14 is inserted into a second side of the first thermal paper roll 15. As such, the first fixing frame 13, the second fixing frame 14 and the first thermal paper roll 15 are combined together. Then, the first fixing shaft 132 of the first fixing frame 13 is received in the first seam 111 of the first supporting element 11, and the second fixing shaft 142 of the second fixing frame 14 is received in the second seam 121 of the second supporting element 12. As such, the combination of the first fixing frame 13, the second fixing frame 14 and the first thermal paper roll 15 is installed in the paper supply mechanism 1. Meanwhile, the process of installing the first thermal paper roll 15 in the paper supply mechanism 1 is finished.

The operations of the conventional thermal transfer printer will be illustrated as follows. When the conventional thermal transfer printer is enabled, a thermal print head (TPH) will heat the coating of the ribbon. By heating the ribbon, the originally solid state of coating will be temporarily transformed into the liquid state and transferred to the first thermal paper. The coating is then cooled, and thus the coating is fixed onto the first thermal paper. After the first thermal paper is ejected out of the thermal transfer printer, the thermal transfer printing operation is finished.

Please refer to FIG. 1 again. When the user wants to use a second thermal paper 18 having a second width W2, the combination of the first fixing frame 13, the second fixing frame 14 and the first thermal paper roll 15 needs to be removed from the paper supply mechanism 1. The second thermal paper 18 is wound around a second thermal paper roll 17. By the above method, the second thermal paper roll 17 is then installed in the paper supply mechanism 1. In other words, the conventional thermal transfer printer may print two kinds of thermal papers with different widths by changing the thermal paper rolls.

The conventional thermal transfer printer, however, still has some drawbacks. For example, during operations of the conventional thermal transfer printer, the first thermal paper roll 15 is rotated with respect to the first fixing frame 13 and the second fixing frame 14. After a long use period, the first thermal paper roll 15 and first fixing frame 13 and the second fixing frame 14 will abrade each other. As such, the first embedding part 131 of the first fixing frame 13 and the second embedding part 141 of the second fixing frame 14 fail to be properly fitted with the first thermal paper roll 15. During operations of the conventional thermal transfer printer under this circumstance, the rotation of the first thermal paper roll 15 becomes unstable, and thus the printing quality is deteriorated.

On the other hand, there are many specifications for the inner diameters of the commercially available thermal paper rolls and ribbon rolls. For example, the common specifications for the roll inner diameters are 0.5 inch, 1 inch and 1.5 inch. In addition, the first embedding part 131 of the first fixing frame 13 and the second embedding part 141 of the second fixing frame 14 are only fitted to the dimensions of the first thermal paper roll 15 and the second thermal paper roll 17. In other words, the first fixing frame 13 and the second fixing frame 14 can be applied to no rolls other than the first thermal paper roll 15 and the second thermal paper roll 17. If the inner diameter of the roll is changed, the fixing frame complying with this inner diameter should be used.

SUMMARY OF THE INVENTION

It is an object of the present invention provides a roll shaft structure complying with various rolls of different inner diameters.

In accordance with an aspect of the present invention, there is provided a roll shaft structure for use in a thermal transfer printer to fix a first roll or a second roll. The first roll has a first roll inner diameter. The second roll has a second roll inner diameter. The second roll inner diameter is greater than the first roll inner diameter. The roll shaft structure includes a shaft body, a first ring, a supporting plate and a stopping part. The shaft body penetrates through the first roll or the second roll, and includes a first notch and a second notch. The first ring is sheathed around the shaft body and movable with respect to the shaft body, and has a first fixing part. When the first ring is moved to a position between the first notch and the second notch and then the first ring is rotated, the first fixing part is engaged with the second notch, so that the first ring is fixed on the shaft body. The supporting plate is arranged at a first end of the shaft body, and has a receiving part for receiving the first ring. The stopping part is arranged at a second end of the shaft body for stopping the first ring and avoiding detachment of the first ring from the shaft body. When the first roll is sheathed around the shaft body, the shaft body is contacted with a first inner wall of the first roll, so that the first roll is fixed on the shaft body. When the second roll is sheathed around the shaft body, the first ring is contacted with a second inner wall of the second roll, so that the second roll is fixed on the shaft body.

In an embodiment, the first notch further includes a first notch rib. When the first ring is moved to the position between the first notch and the second notch, the first ring is blocked by the first notch rib from being rotated in a first rotating direction but the first ring is permitted to rotate in a second rotating direction opposed to the first rotating direction, so that the first fixing part is engaged with the second notch and the first ring is fixed on the shaft body.

In an embodiment, the roll shaft structure further includes a second ring, which is sheathed around the shaft body and movable with respect to the shaft body and has a second fixing part. When the second ring is moved to the position between the first notch and the second notch and then the second ring is rotated in the second rotating direction, the second fixing part is engaged with the second notch, so that the second ring is fixed on the shaft body.

In an embodiment, when the second roll is sheathed around the shaft body, the first ring is contacted with the second inner wall of the second roll to fix the second roll on the shaft body, so that the shaft body is synchronously rotated with the second roll in the first rotating direction to prevent disengagement of the first fixing part from the second notch.

In an embodiment, the shaft body further includes a first guiding groove, and the first ring is movable with respect to the shaft body along the first guiding groove.

In an embodiment, the first ring further includes plural first ring ribs. When the second roll is sheathed around the shaft body, the first ring ribs are contacted with the second inner wall of the second roll, so that the second roll is fixed on the shaft body.

In an embodiment, the shaft body has a shaft body diameter, and the shaft body diameter is equal to the first roll inner diameter.

In an embodiment, the first ring has a ring diameter, and the ring diameter is equal to the second roll inner diameter.

In an embodiment, the first roll is a ribbon roll or a thermal paper roll.

In an embodiment, the second roll is a ribbon roll or a thermal paper roll.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
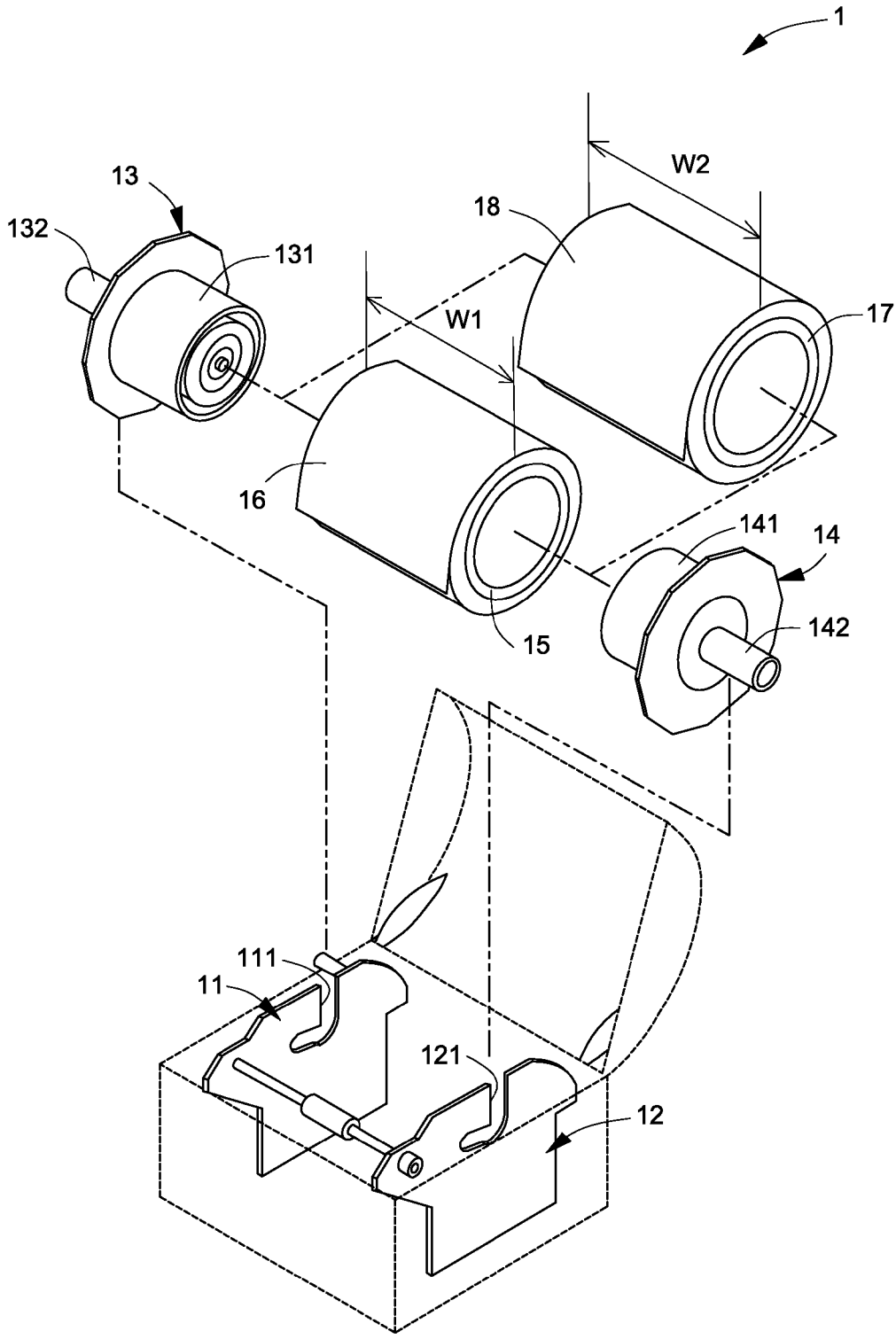
FIG.1 (PRIOR ART)
FIG. 1 is a schematic exploded view illustrating a paper supply mechanism of a conventional thermal transfer printer.
Figure 2:
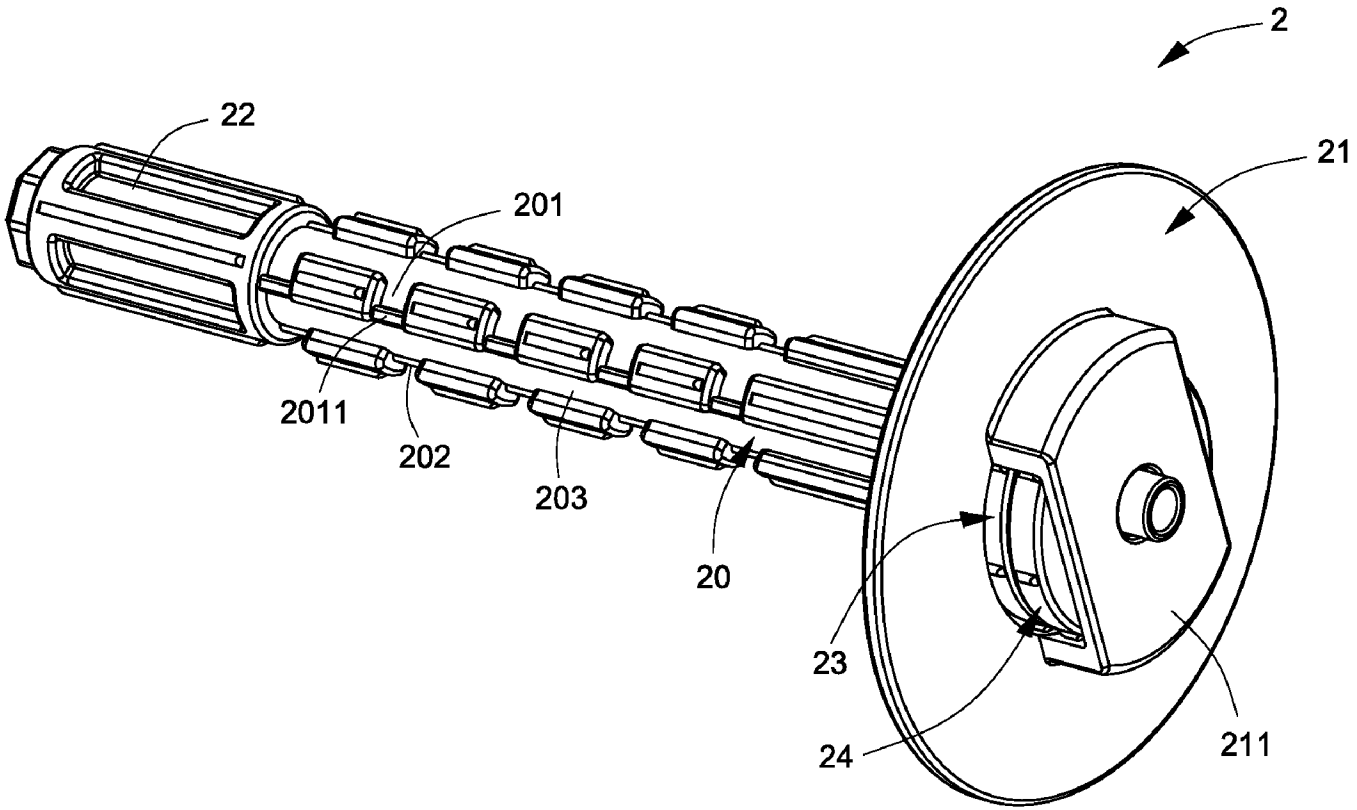
FIG. 2 is a schematic perspective view illustrating a roll shaft structure according to an embodiment of the present invention.
Figure 3:
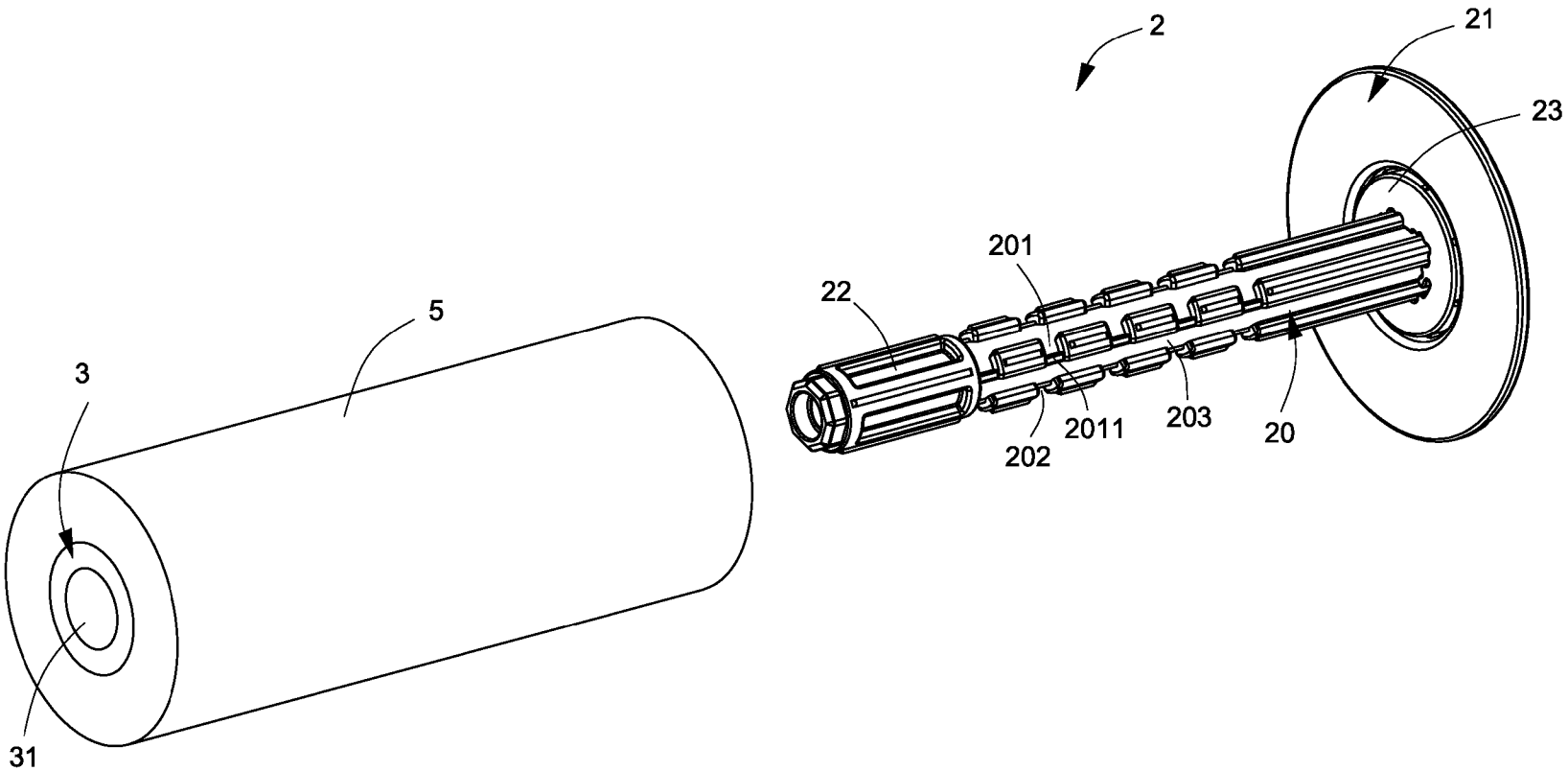
FIG. 3 is a schematic perspective view illustrating the roll shaft structure taken along another viewpoint and a first roll according to an embodiment of the present invention.

For obviating the drawbacks encountered from the prior art, the present invention provides a roll shaft structure. FIG. 2 is a schematic perspective view illustrating a roll shaft structure according to an embodiment of the present invention. FIG. 3 is a schematic perspective view illustrating the roll shaft structure taken along another viewpoint and a first roll according to an embodiment of the present invention. In this embodiment, the roll shaft structure 2 is applied to a thermal transfer printer (not shown) for fixing a first roll 3 or a second roll 4 (see FIG. 6). The roll shaft structure 2 comprises a shaft body 20, a supporting plate 21, a stopping part 22, a first ring 23 and a second ring 24. The shaft body 20 has a first notch 201, a second notch 202 and a first guiding groove 203. A first notch rib 2011 is formed in the first notch 201. The supporting plate 21 is arranged at a first end of the shaft body 20. The supporting plate 21 has a receiving part 211 for receiving the first ring 23 and the second ring 24. The stopping part 22 is arranged at a second end of the shaft body 20 for stopping the first ring 23 and the second ring 24 and avoiding detachment of the first ring 23 and the second ring 24 from the shaft body 20. As shown in FIG. 3, the first ring 23 and the second ring 24 are received in the receiving part 211.

Figure 4:
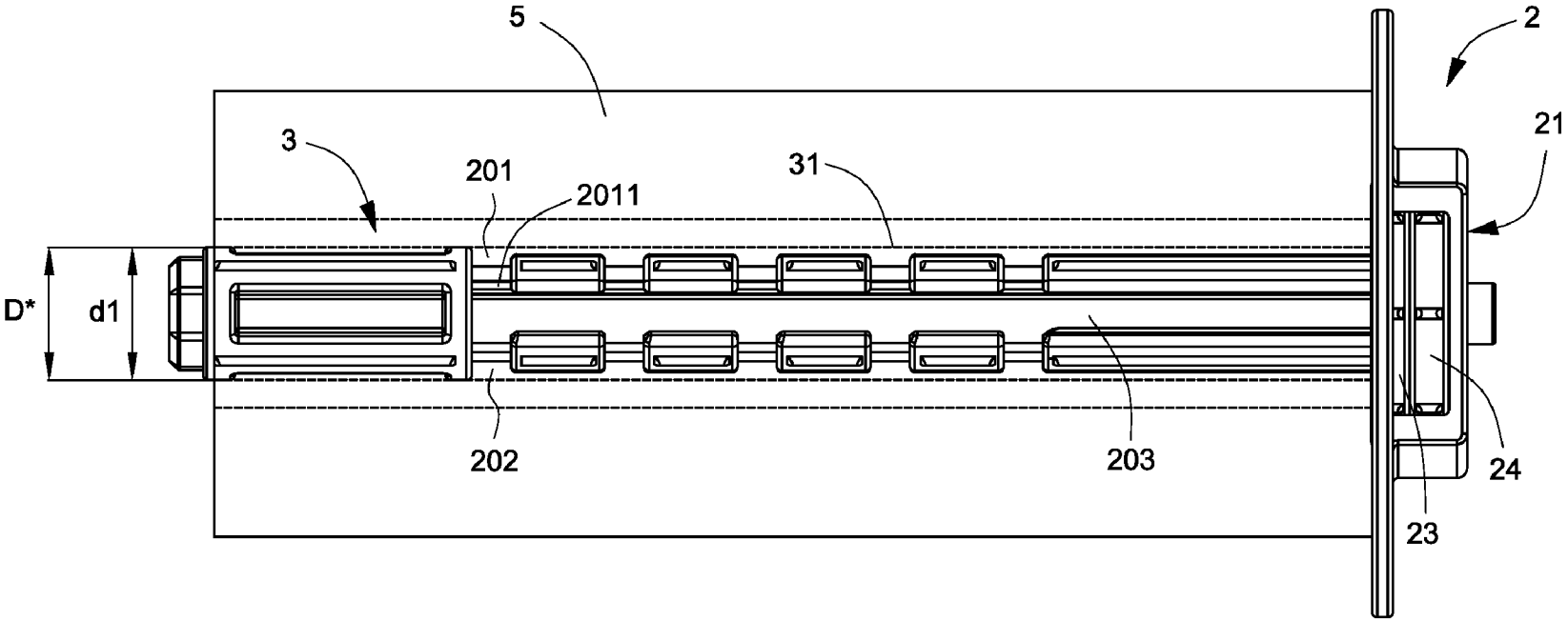
FIG. 4 is a schematic side view illustrating the roll shaft structure penetrating through the first roll according to an embodiment of the present invention.

FIG. 4 is a schematic side view illustrating the roll shaft structure penetrating through the first roll according to an embodiment of the present invention. In this embodiment, the first roll 3 is a thermal paper roll, wherein a first thermal paper 5 is wound around the first roll 3. As shown in FIG. 4, the first roll 3 has a first roll inner diameter d1, and the shaft body 20 has a shaft body diameter D*. The shaft body diameter D* is equal to the first roll inner diameter d1. For installing the first thermal paper 5 in the thermal transfer printer, the shaft body 20 of the roll shaft structure 2 firstly penetrates through the first roll 3 such that the first roll 3 is sheathed around the shaft body 20. Since the shaft body diameter D* of the shaft body 20 is equal to the first roll inner diameter d1 of the first roll 3, the shaft body 20 is contacted with a first inner wall 31 of the first roll 3. In this situation, the first roll 3 is fixed on the shaft body 20, and the shaft body 20 is synchronously rotated with the first roll 3. Afterwards, the combination of the first roll 3 and the roll shaft structure 2 is installed in the thermal transfer printer. The method of sheathing the first roll 3 around the roll shaft structure 2 has been described above. Hereinafter, a method of sheathing a second roll 4 around the roll shaft structure 2 will be illustrated in more details, wherein the second roll 4 and the first roll 3 have different inner diameters.

Figure 5:
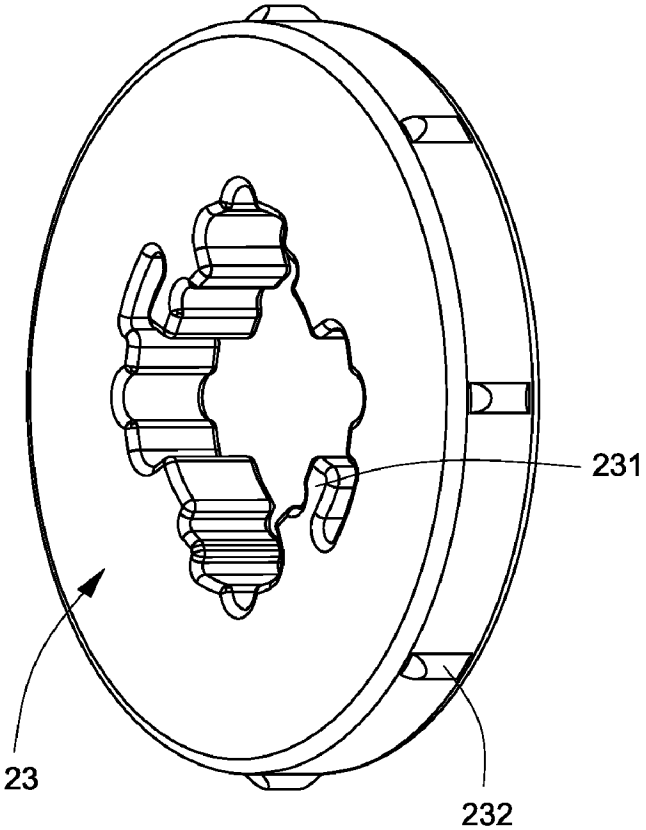
FIG. 5 is a schematic perspective view illustrating the first ring of the roll shaft structure according to an embodiment of the present invention.

Firstly, the configurations of the first ring 23 of the roll shaft structure 2 will be illustrated with reference to FIG. 5. FIG. 5 is a schematic perspective view illustrating the first ring of the roll shaft structure according to an embodiment of the present invention. The first ring 23 has a first fixing part 231 and plural first ring ribs 232. The first fixing part 231 is formed on the inner periphery of the first ring 23 and permitted to be contacted with the shaft body 20. The first fixing part 231 is inserted in the first guiding groove 203 between the first notch 201 and the second notch 202. The plural first ring ribs 232 are formed on the outer periphery of the first ring 23. Similarly, the second ring 24 has a second fixing part 241 (see FIG. 6) and plural second ring ribs 242 (see FIG. 6). The configurations of the second ring 24 are the same as the first ring 23.

Figure 6:
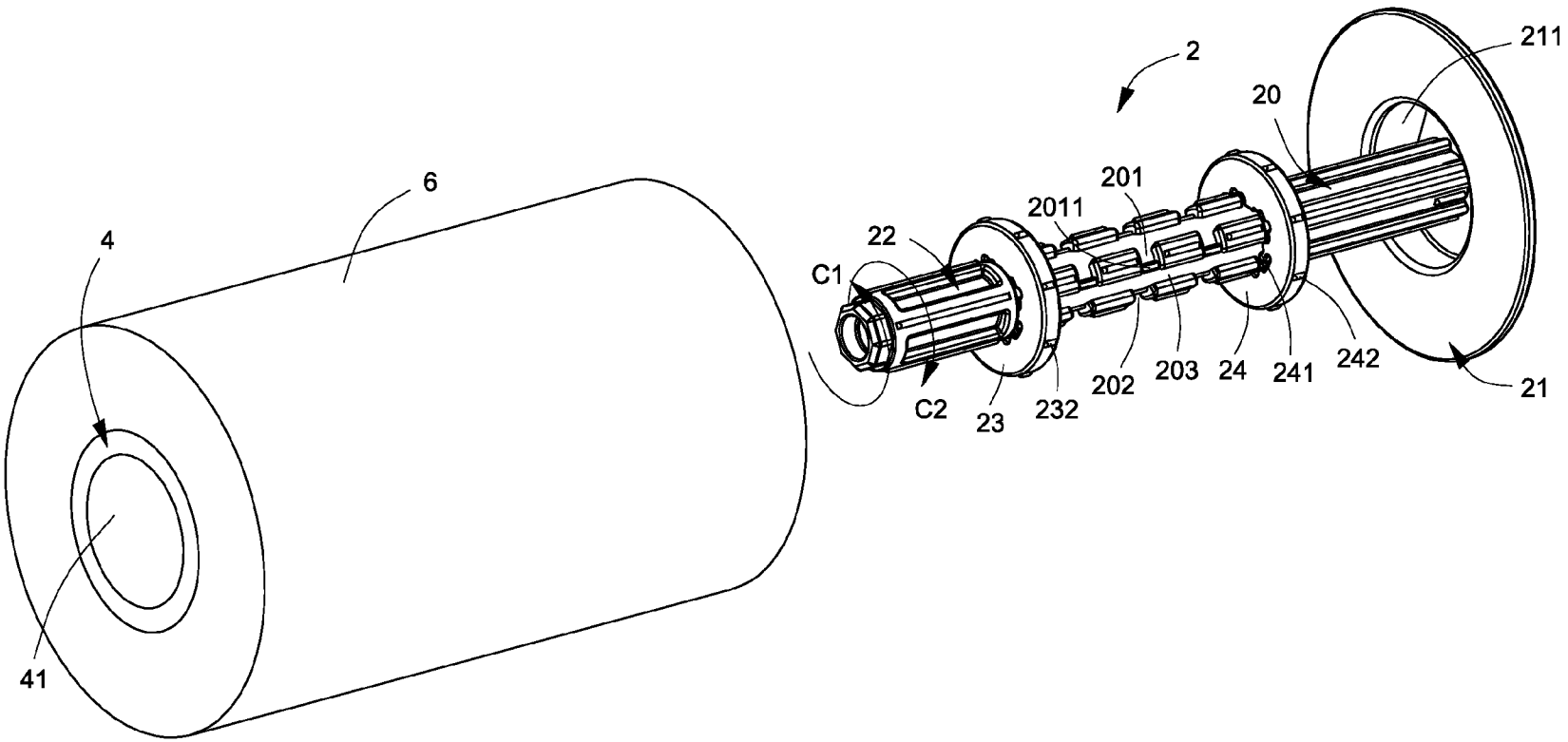
FIG. 6 is a schematic perspective view illustrating the engagement between the rings of the roll shaft structure and respective notches according to an embodiment of the present invention.

FIG. 6 is a schematic perspective view illustrating the engagement between the rings of the roll shaft structure and respective notches according to an embodiment of the present invention. As shown in FIG. 6, a second thermal paper 6 is wound around the second roll 4. When the user wants to replace the first thermal paper 5 of the thermal transfer printer with the second thermal paper 6, the first ring 23 received within the receiving part 211 may be firstly moved to a first position between the first notch 201 and the second notch 202 of the shaft body 20 along the first guiding groove 203. The first notch 201 and the second notch 202 are hidden, and not shown in FIG. 6. Next, the second ring 24 received within the receiving part 211 is moved to a second position between another first notch 201 and another second notch 202. Meanwhile, as shown in FIG. 6, the first ring 23 and the second ring 24 are separated from each other by a specified distance.

After the first ring 23 is aligned with the first position between the first notch 201 and the second notch 202 and the second ring 24 is aligned with the second position between the another first notch 201 and the another second notch 202, the first ring 23 and the second ring 24 are rotated in a second rotating direction C2. As such, the first fixing part 231 of the first ring 23 is engaged with the second notch 202, and the second fixing part 241 of the second ring 24 is engaged with another second notch 202. Meanwhile, the first ring 23 and the second ring 24 are fixed on the shaft body 20.

Especially, when the first ring 23 is aligned with the first position between the first notch 201 and the second notch 202, the first fixing part 231 is blocked by the first notch rib 2011 of the first notch 201, so that the first ring 23 is only permitted to rotate in the second rotating direction C2 but fails to be rotated in a first rotating direction C1, which is opposed to the second rotating direction C2. Similarly, the second ring 24 is only permitted to rotate in the second rotating direction C2 but fails to be rotated in the first rotating direction C1.

Figure 7:
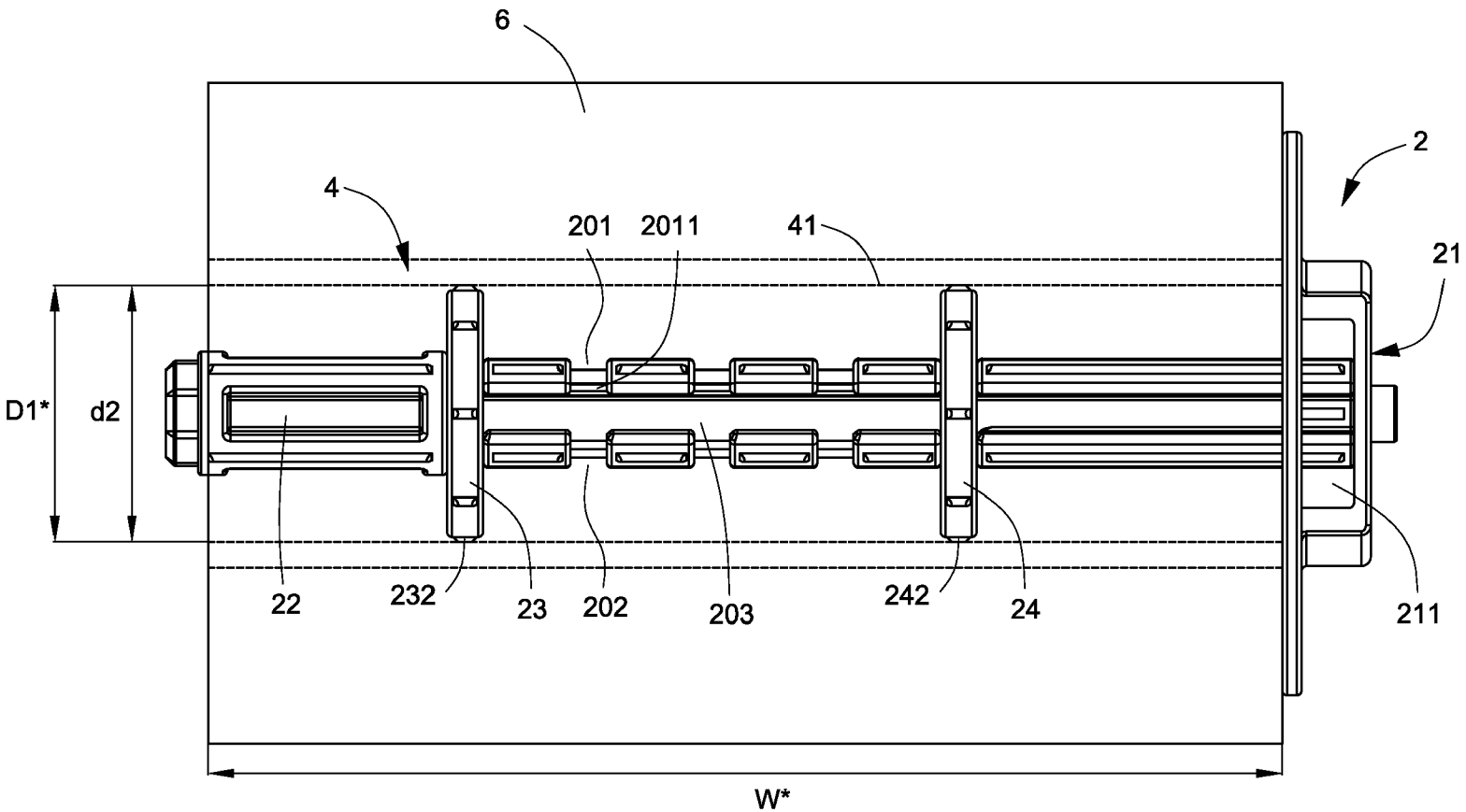
FIG. 7 is a schematic side view illustrating the roll shaft structure penetrating through the second roll according to an embodiment of the present invention.

FIG. 7 is a schematic side view illustrating the roll shaft structure penetrating through the second roll according to an embodiment of the present invention. As shown in FIG. 7, the shaft body 20 of the roll shaft structure 2 penetrates through the second roll 4 such that the second roll 4 is sheathed around the shaft body 20. As shown in FIG. 7, each of the first ring 23 and the second ring 24 has a ring diameter D1*, and the second roll 4 has a second roll inner diameter d2. The ring diameter D1* is equal to the second roll inner diameter d2. Since the ring diameter D1* of each of the first ring 23 and the second ring 24 is equal to the second roll inner diameter d2 of the second roll 4, the first ring ribs 232 formed on the outer periphery of the first ring 23 and the second ring ribs 242 formed on the outer periphery of the second ring 24 are respectively contacted with a second inner wall 41 of the second roll 4. In this situation, the second roll 4 is fixed on the shaft body 20, and the shaft body 20 is synchronously rotated with the second roll 4. Afterwards, the combination of the second roll 4 and the roll shaft structure 2 is installed in the thermal transfer printer.

In accordance with another key feature of the present invention, plural first notches 201 and plural second notches 202 are formed in the shaft body 20. According to the width W* of the second roll 4, the distance between the first ring 23 and the second ring 24 is adjustable. By adjusting the distance between the first ring 23 and the second ring 24, the first ring 23 is close to an end of the second roll 4, and the second ring 24 is close to the other end of the second roll 4. As such, the second roll 4 is fixed on the shaft body 20 and failed to be easily loosened.

In this embodiment, the first roll 3 and the second roll 4 are illustrated by referring to thermal paper rolls. Nevertheless, the roll shaft structure of the present invention is not limited to be applied to the thermal paper rolls. For example, the roll shaft structure of the present invention may be applied to a ribbon roll. That is, in some embodiments, the first roll and the second roll are ribbon rolls.

From the above description, the profiles of the roll shaft structure of the present invention are adjustable, so that various rolls with different inner diameters can be sheathed around the roll shaft structure. Moreover, depending on different widths of the rolls, the distance between the first ring and the second ring is adjusted to increase the stability of fixing the roll. In comparison with the prior art technology, the roll shaft structure of the present invention can be applied to various rolls with different inner diameters. Moreover, since the roll sheathed around the roll shaft structure is synchronously rotated with the roll shaft structure, the abrasion between the roll shaft structure and the roll will be eliminated. As a consequence, stable rotation of roll shaft structure and the roll can be maintained for a long use period, and the printing quality of the thermal transfer printer is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A roll shaft structure for use in a thermal transfer printer to fix a first roll or a second roll, said first roll having a first roll inner diameter, said second roll having a second roll inner diameter, said second roll inner diameter being greater than said first roll inner diameter, said roll shaft structure comprising:

a shaft body penetrating through said first roll or said second roll, and comprising a first notch and a second notch;

a first ring sheathed around said shaft body and movable with respect to said shaft body, and having a first fixing part, wherein when said first ring is moved to a position between said first notch and said second notch and then said first ring is rotated, said first fixing part is engaged with said second notch, so that said first ring is fixed on said shaft body;

a supporting plate arranged at a first end of said shaft body, and having a receiving part for receiving said first ring; and a stopping part arranged at a second end of said shaft body for stopping said first ring and avoiding detachment of said first ring from said shaft body, wherein when said first roll is sheathed around said shaft body, said shaft body is contacted with a first inner wall of said first roll, so that said first roll is fixed on said shaft body, wherein when said second roll is sheathed around said shaft body, said first ring is contacted with a second inner wall of said second roll, so that said second roll is fixed on said shaft body.

2. The roll shaft structure according to claim 1 wherein said first notch further includes a first notch rib, wherein when said first ring is moved to said position between said first notch and said second notch, said first ring is blocked by said first notch rib from being rotated in a first rotating direction but said first ring is permitted to rotate in a second rotating direction opposed to said first rotating direction, so that said first fixing part is engaged with said second notch and said first ring is fixed on said shaft body.

3. The roll shaft structure according to claim 2 further comprising a second ring, which is sheathed around said shaft body and movable with respect to said shaft body and has a second fixing part, wherein when said second ring is moved to said position between said first notch and said second notch and then said second ring is rotated in said second rotating direction, said second fixing part is engaged with said second notch, so that said second ring is fixed on said shaft body.

4. The roll shaft structure according to claim 2 wherein when said second roll is sheathed around said shaft body, said first ring is contacted with said second inner wall of said second roll to fix said second roll on said shaft body, so that said shaft body is synchronously rotated with said second roll in said first rotating direction to prevent disengagement of said first fixing part from said second notch.

5. The roll shaft structure according to claim 1 wherein said shaft body further comprises a first guiding groove, and said first ring is movable with respect to said shaft body along said first guiding groove.

6. The roll shaft structure according to claim 1 wherein said first ring further comprises plural first ring ribs, wherein when said second roll is sheathed around said shaft body, said first ring ribs are contacted with said second inner wall of said second roll, so that said second roll is fixed on said shaft body.

7. The roll shaft structure according to claim 1 wherein said shaft body has a shaft body diameter, and said shaft body diameter is equal to said first roll inner diameter.

8. The roll shaft structure according to claim 1 wherein said first ring has a ring diameter, and said ring diameter is equal to said second roll inner diameter.

9. The roll shaft structure according to claim 1 wherein said first roll is a ribbon roll or a thermal paper roll.

10. The roll shaft structure according to claim 1 wherein said second roll is a ribbon roll or a thermal paper roll.

* * * * *